US006953176B2

(12) United States Patent
Remmers

(10) Patent No.: US 6,953,176 B2
(45) Date of Patent: Oct. 11, 2005

(54) STANDARD AND TRACK SHELVING SYSTEM

(75) Inventor: Lee Remmers, Ocala, FL (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/657,855

(22) Filed: Sep. 9, 2003

(65) Prior Publication Data

US 2004/0045919 A1 Mar. 11, 2004

Related U.S. Application Data

(63) Continuation of application No. 09/436,363, filed on Nov. 9, 1999, now Pat. No. 6,669,154.

(51) Int. Cl.[7] ..... E04G 5/06
(52) U.S. Cl. ..... 248/225.11; 211/187; 211/94.01
(58) Field of Search ..... 248/225.11, 220.43, 248/220.41, 244; 211/90.01, 94.01, 184, 187; 52/36.4, 36.6

(56) References Cited

U.S. PATENT DOCUMENTS

| | | | | |
|---|---|---|---|---|
| 4,678,151 A | | 7/1987 | Radek | |
| 5,101,989 A | | 4/1992 | Jones | |
| 5,110,080 A | * | 5/1992 | Rieman | 248/225.11 |
| 5,135,194 A | | 8/1992 | Laughon et al. | |
| 5,185,971 A | | 2/1993 | Johnson, Jr. | |
| 5,638,644 A | * | 6/1997 | Bastian | 52/36.6 |
| 5,819,958 A | * | 10/1998 | Dement | 211/90.01 |
| 6,050,426 A | | 4/2000 | Leurdijk | |
| 6,119,878 A | | 9/2000 | Zen | |
| 6,520,355 B1 | * | 2/2003 | Pritchard et al. | 211/187 |
| 6,659,295 B1 | * | 12/2003 | De Land et al. | 211/187 |
| 6,669,154 B1 | * | 12/2003 | Remmers | 248/225.11 |

* cited by examiner

*Primary Examiner*—Leslie A. Braun
*Assistant Examiner*—Tan Le
(74) *Attorney, Agent, or Firm*—Harness, Dickey & Pierce; Anthony G. Fussner

(57) ABSTRACT

The present invention relates to a vertical support standard and track into which the standard can be mounted. The standard contains a plurality of slots in its front surface such that one or more ordinary shelving brackets can be mounted thereon, and contains an opening on its back surface such that it can be mounted to a track upon which the wall standard may be able to slide. The track contains a lip and support portion. The lip extends over the front of the standard to keep it mounted to the track, and the support portion can be inserted into the opening on the back of the standard to provide added support and to allow sliding of the standard if desired. This standard and track configuration thus not only allows greater flexibility for the consumer as to the placement of shelving brackets, but provides greater support and increased loading capacity such that more items can be placed on a shelf that is mounted to the disclosed shelving system.

14 Claims, 4 Drawing Sheets

STANDARD AND TRACK SHELVING SYSTEM

This application claims priority from U.S. application Ser. No. 09/436,363, filed Nov. 9, 1999, now U.S. Pat. No. 6,669,154.

FIELD OF THE INVENTION

The present invention relates generally to the use of vertical support standards to support shelving brackets. More particularly, it concerns the combination of a vertical support standard and track system that provides greater support and consumer flexibility to closet shelving arrangements.

DESCRIPTION OF RELATED ART

Vertical support standards for the purpose of supporting shelving brackets are well known in the art. These standards are often comprised of narrow strips that may be mounted vertically against a wall and contain a plurality of slots such that tabs of shelving brackets can be inserted and supported by such standards. Vertical shelving standards are typically mounted to a wall through screws or other means such that the standard is not generally mobile or removable from its position if desired by the consumer after installation. Additional improvements thus in the manner of flexibility in positioning such standards combined with added strength and load bearing capacity thus remains warranted.

SUMMARY OF THE INVENTION

The present invention relates to a vertical support standard and track system for supporting shelving brackets, such that the standard is able to receive greater loading capacity and can be moved prior to final positioning, if desired, to various positions across a wall through use of a track. The horizontally mounted track provides added support to increase the loading that can be placed on the standard and also provides the ability for such standard to be moved to various positions along the track's length. Illustratively, the invention comprises a shelving apparatus containing a vertical support standard and a track, and can include a shelf and shelving bracket mounted to the standard. The standard may be constructed like a typical wall mounted standard having front and back sides. The front side of the standard may contain a plurality of slots so as to be able to receive tabs or other mounting means of a shelving bracket. The standard can contain one or more columns of slots so as to accept one or more, or multi-sided shelving brackets. The back side of the standard, preferably near a top portion, defines an opening having upper and lower surfaces. This opening should be constructed in such a way that it can receive a support portion of a track. The standard may also be able to be moved horizontally along a wall mounted track without becoming detached from the track.

Another component of the invention is a track which can be mounted to a wall by any typical mounting means. The track comprises a body which is able to accept a standard as disclosed above. In order to keep such a standard mounted to the track, the track preferably has a lip that extends downwardly and overlaps a front surface of the top portion of the standard so as to prevent the standard from disengaging from the track. The track also has a support portion having upper and lower surfaces that is adapted to be inserted into the opening on the back of the standard. The opening on the standard and the support portion of the track are preferably aligned so that the front lip of the track is able to engage a front portion of the standard.

The top portion of the standard that engages the lip of the track, and the upper surface of the opening that engages the upper surface of the support portion of the track, provide support for downward loading placed on the standard and keep the standard locked into the track. The lower surface of the opening prevents the standard from being pushed up and disjointed from the track by engaging the lower surface of the support portion of the track. When mounted on the track, the standard is preferably able to move horizontally along the support portion so as to be placed in a desired position by the consumer prior to first mounting of the standard to a wall. In this way, a shelf bracket and shelving system can be mounted to the standard in a location preferable to the consumer while providing maximum support and accepting greater amount of loading such as by an attached bracket and shelf.

BRIEF DESCRIPTION OF THE DRAWINGS

The following drawings form part of the specification and are included to further demonstrate certain aspects of the present invention. The invention may be better understood by reference to one or more of these drawings in combination with the detailed description presented herein.

DETAILED DESCRIPTION

Figure 1:
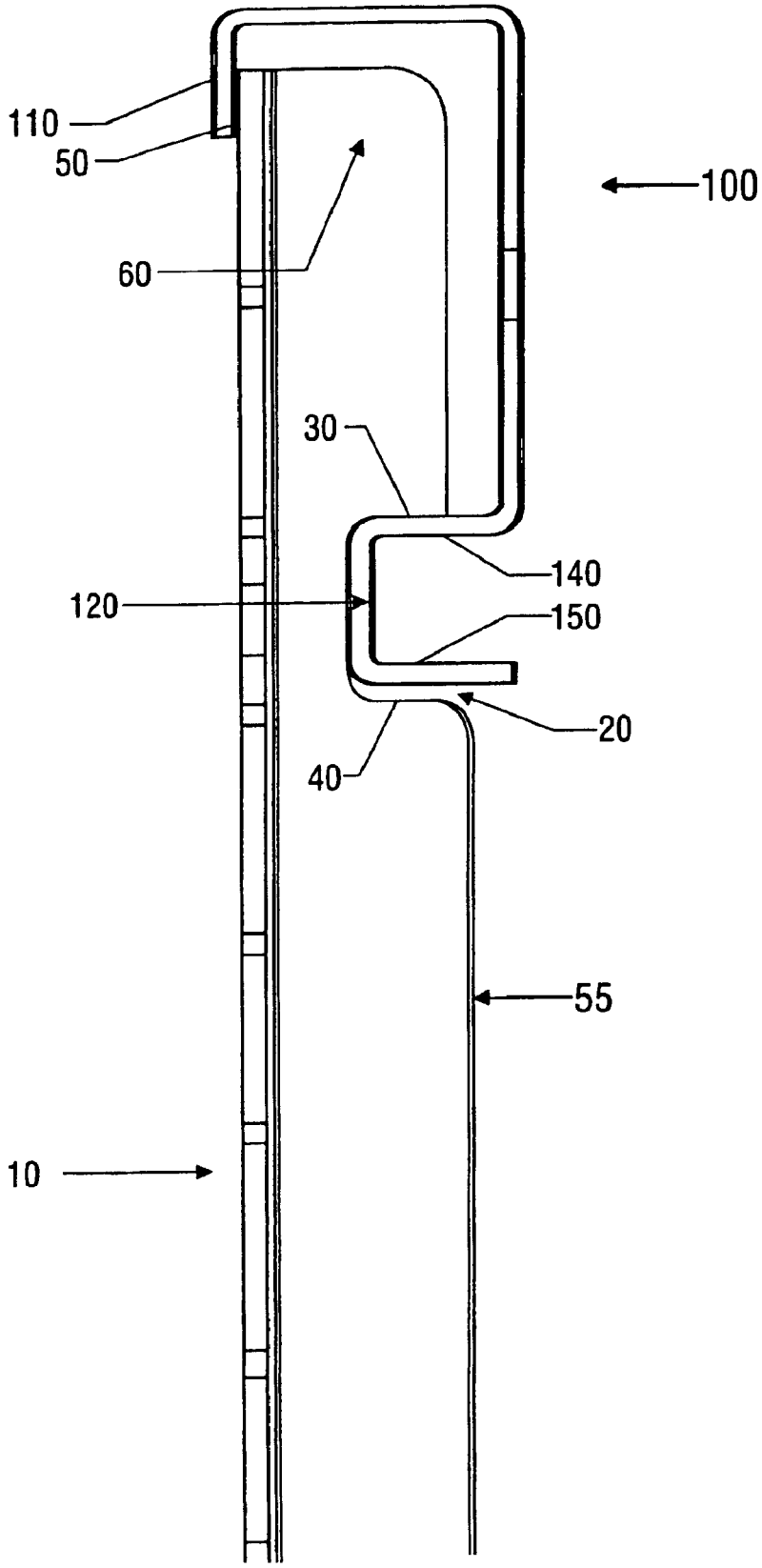
FIG. 1 is a side view of an embodiment of the shelving apparatus.
Figure 3:
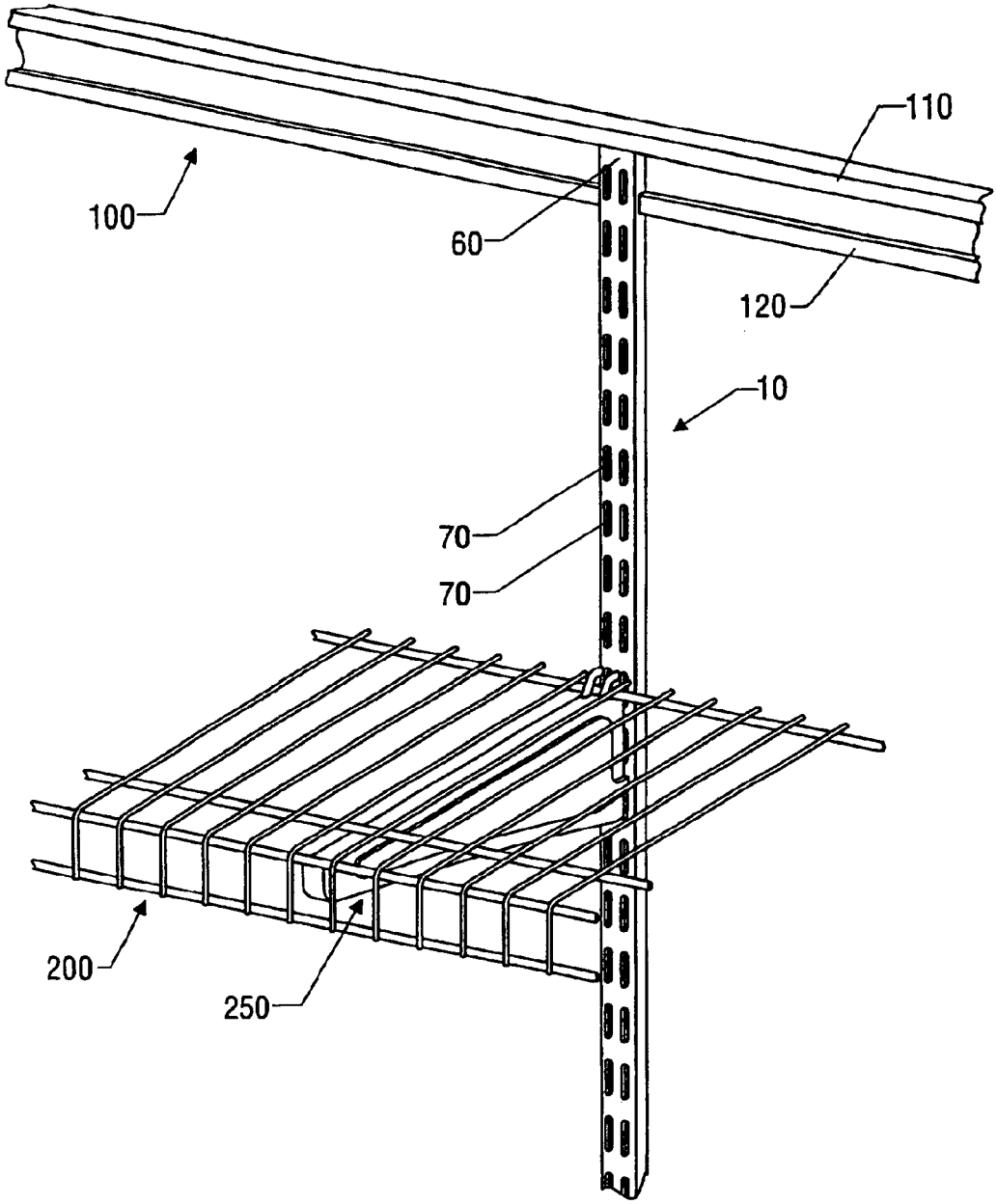
FIG. 3 is a perspective view of an embodiment of the shelving apparatus, with a bracket and shelf mounted to the standard.

In FIG. 1, a cross-sectional side view of a shelving apparatus is disclosed. The shelving apparatus comprises a standard 10 and a track 100. The embodiment of the standard 10 shown comprises a front surface 50 and back surface 55, as well as a top portion 60. The front surface 50 defines slots 70 (as shown in FIG. 3), which in other embodiments can be of any size and shape such that a shelving bracket may be mounted thereto. Alternatively, instead of slots, any other means of mounting a bracket, such as protrusions, may be used on front surface 50. As shown in FIG. 1, the back portion 55 of the standard 10 defines an opening 20 for supporting the standard 10 on the track 100. The opening 20 defines an upper surface 30 and lower surface 40, and is preferably U-shaped such that such upper and lower surfaces are generally horizontal in orientation. The opening, however, can be of any shape such that it can receive and be supported by an opposing supporting member and is preferably slidable along that member. The opening 20 can be located on any portion of the standard such that it is supported by engaging with a track.

Also shown in FIGS. 1 and 3 is a track 100, which can be mounted on a wall or other surface, preferably horizontally. Track 100 may be constructed of any material suitable for standards or brackets, such as steel or aluminum. Track 100 also has a length such that standard 10 can preferably slide horizontally along its length. As shown in FIG. 1, the cross-section of an embodiment of track 100 is preferably shaped like a backward S and defines a front lip 110 that is designed to abut the front surface 50 of the standard 10 such that the standard 10 is held within track 100. Lip 110 preferably extends some distance over the top 60 of standard 10 and comes into contact with the front surface 50 such that when jarred or otherwise moved, the standard 10 is not released from the track 100. Any means, however, such as a latch or other mechanism can also be used in place of the lip 110, as long as the standard 10 remains held within track 100.

Track 100 also defines a support portion 120 that, when engaged with the opening 20, supports the standard and prevents it from being pushed upward and separated from track 100. In one embodiment of track 100, support portion 120, as shown in cross section in FIG. 1, is U-shaped and is adapted to extend into opening 20 on standard 10. Support portion 120 comprises upper surface 140 and bottom surface 150. Upper surface 140 supports standard 10, such as when a shelf and shelving bracket and the contents of the shelf are connected to the standard 10. Bottom surface 150 prevents standard 10 from being disengaged from track 100 if the standard is pushed or jarred in a upward direction by engaging with lower surface 40 of opening 20. Support portion 120 may also be designed to allow standard 10 to slide horizontally along the track if desired, as shown in FIG. 3. Once in a desired position, the portion of the standard not engaged with the track may thereafter be secured to a wall to prevent any further movement of the standard from its desired position.

Alternative embodiments of support portion 120 may also be used. Such alternative configurations need only provide an upper and bottom surface adapted to engage opening 20, or other means to support the standard 10 while preferably allowing the standard to slide if desired. Additionally, support portion 120 is not required to be at the bottom of track 100, but can be located at any place on the track such that it can engage with an opening on the back surface of a wall standard and provide the benefits as described above. Preferably, however, support portion 120 is located in a position that when inserted into opening 20, lip 110 will be engaged with front surface 50 of standard 10. Thus, as shown in FIG. 1, distance y (the distance between the top 60 of the standard and bottom of the lip 110) is preferably greater than distance x (the space between the lower surface 40 and bottom surface 150 when the upper surface 140 of the track 100 is in contact with the upper surface 30 of the standard's opening 20). Also, track 100 may be of any cross-sectional design such that it provides the benefits as described above.

Figure 4:
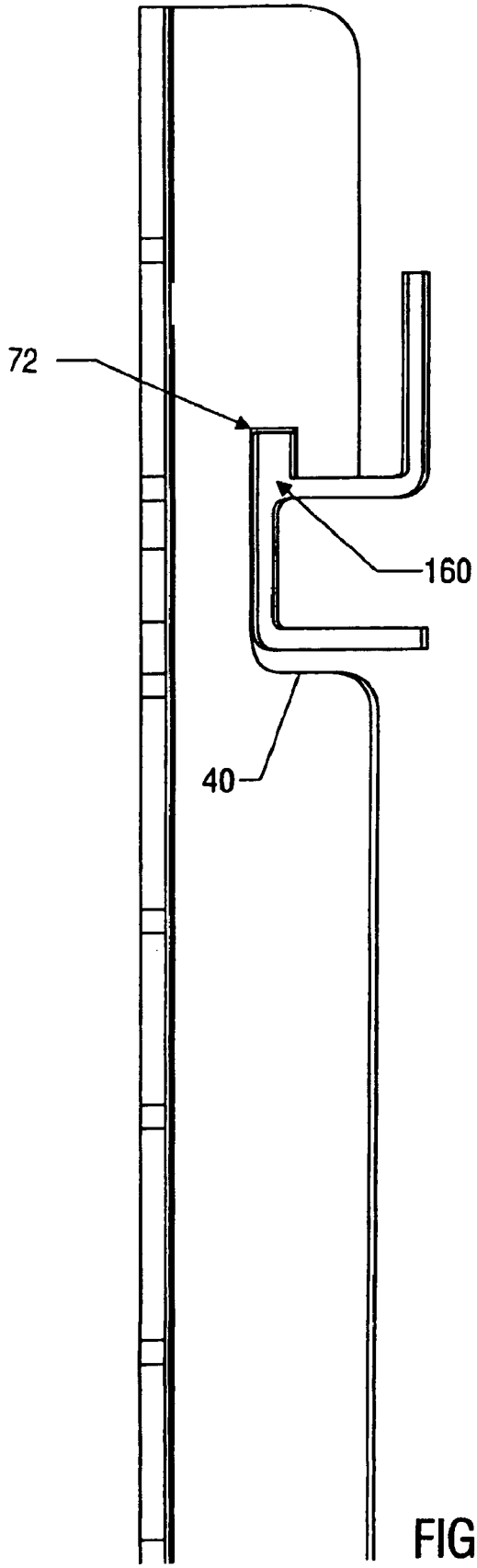
FIG. 4 is a side view of an alternative embodiment of the shelving apparatus.

In an alternative embodiment as shown in FIG. 4, lip 110 may be eliminated altogether by support portion 120 both providing support and keeping the standard 10 connected to the track. For example, support portion 120 can comprise not only upper and bottom surfaces 140 and 150, but can comprise extension 160 that provides the same function as did the lip 110. In one such embodiment (as shown in FIG. 4), extension 160 prevents the standard 10 from disengaging from the track 100 by engaging a notch (or hole) 72 in opening 20. The notch 72 and extension 160 may be located on the opening 20 and support member 120 respectively (or vice versa) in any position such that they can engage each other and prevent the standard 10 from disengaging from track 100. The standard is also preferably slidable along the track 100 in this embodiment.

A method of mounting the standard 10 to track 100 is also disclosed herein. Track 100 is first secured to a wall or other surface, preferably in a substantially horizontal manner. A top portion of the standard 10 is then inserted under lip 110 and standard 10 rotated such that the opening 20 on the back 55 of the standard 10 engages the support portion 120 of the track 100. The standard 10 may then be slid along track 100 until it is in a desired position and then attached to the wall to prevent further movement along the track 100.

Figure 2:
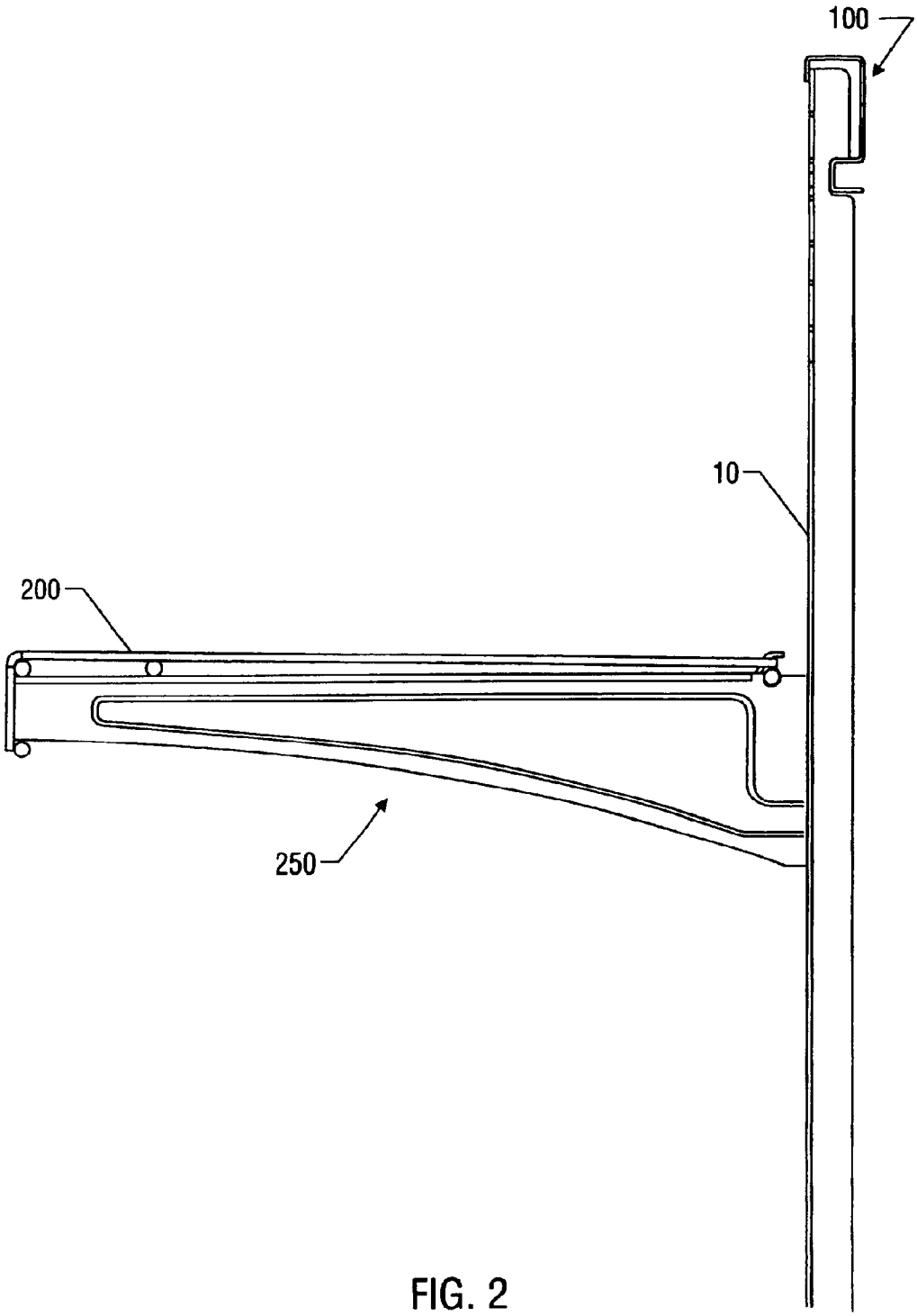
FIG. 2 shows a side view of an embodiment of the shelving apparatus, with the standard having a bracket and shelf mounted thereon.

As shown in FIGS. 2 and 3, standard 10 and track 100 may be used in combination with a shelf 200 and/or shelving bracket 250. Such bracket and shelf can be of any type ordinarily used with vertical wall standards. As described above, standard 10, in combination with track 100 not only preferably allows standard 10 to be horizontally moved so that bracket 250 and shelf 200 can be supported in a position desired by the consumer, but also provides additional support and increased loading capacity for the shelf and bracket.

These examples are included to demonstrate preferred embodiments of the invention. It should be appreciated by those of skill in the art that the techniques disclosed in the examples represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

What is claimed is:

1. A shelving system comprising:

a track having a support portion and a retaining lip, said support portion having an upper horizontal planar support surface and a lower horizontal planar surface, said upper horizontal planar support surface being vertically spaced from said lower horizontal planar surface;

a standard having a front surface defining a plurality of apertures therethrough to receive a shelf bracket, and a back surface opposite the front surface;

said back surface defining an opening therein, said opening having an upper horizontal planar surface that contacts said upper horizontal p said front surface having a top portion that contacts said retaining lip when said support portion is within said opening; and a shelf supportable by the standard.

2. The shelving system of claim 1, wherein the standard is slidably movable along the track.

3. The shelving system of claim 1, wherein the support portion of the track includes a generally U-shaped cross-section.

4. The shelving system of claim 1, further comprising the shelf bracket mountable to one or more of the apertures.

5. The shelving system of claim 4, wherein the shelf is supportable by the shelf bracket.

6. The shelving system of claim 1, wherein the track includes a generally backward S-shaped cross-section.

7. The shelving system of claim 1, wherein the opening defined by the back surface of the standard includes a generally U-shaped cross-section.

8. A method for supporting a shelf comprising:

providing a track having a support portion and a retaining lip, said support portion having an upper horizontal planar support surface and a lower horizontal planar surface, said upper horizontal planar support surface being vertically spaced from said lower horizontal planar surface;

supporting a standard with the track, the standard having a front surface defining a plurality of apertures therethrough to receive a shelf bracket, and a back surface opposite the front surface, said back surface defining an opening therein, said opening having an upper horizontal planar surface that contacts said upper horizontal planar support surface of said track, said front surface having a top portion that contacts said retaining lip when said support portion is within said opening; and supporting a shelf on the standard.

9. The method of claim 8, wherein supporting a shelf on the standard comprises:

mounting the shelf bracket to one or more of the apertures; and supporting the shelf with the bracket.

10. The method of claim 8, wherein supporting the standard with the track comprises:

inserting the top portion of the standard into the track such that the front surface of the standard engages the retaining lip; and rotating the standard such that the opening engages the support portion of the track with the upper horizontal planar support surface of the support portion contacting the upper horizontal planar surface of the opening.

11. The method of claim 8, further comprising sliding the standard along the track.

12. The method of claim 11, further comprising attaching the standard to a wall after sliding the standard along the track.

13. A shelving system comprising:

a track having means for supporting a standard, and means for retaining the standard within the track, the means for supporting the standard including an upper horizontal planar support surface and a lower horizontal planar surface, said upper horizontal planar support surface being vertically spaced from said lower horizontal planar surface;

a shelf supportable by said standard;

the standard having means for receiving a shelf bracket, and means for defining an opening sized to received the means for supporting, the opening having an upper horizontal planar surface that contacts the upper horizontal planar support surface of said means for supporting when the means for supporting is within the opening;

the standard comprises a front surface having a top portion; and the means for retaining contacts the top portion of the front surface of the standard when the standard is engaged with the track.

14. The shelving system of claim 13, wherein the standard is slidably movable along the track.

* * * * *

UNITED STATES PATENT AND TRADEMARK OFFICE

CERTIFICATE OF CORRECTION

PATENT NO. : 6,953,176 B2
DATED : October 11, 2005
INVENTOR(S) : Lee Remmers

It is certified that error appears in the above-identified patent and that said Letters Patent is hereby corrected as shown below:

Column 4,
Line 31, replace “horizontal p” with -- horizontal planar support surface of said track; --.

Signed and Sealed this

Seventh Day of February, 2006

JON W. DUDAS
*Director of the United States Patent and Trademark Office*